United States Patent [19]

Kunita et al.

[11] Patent Number: 4,502,382

[45] Date of Patent: Mar. 5, 1985

[54] HEAD FOR IMPACT TYPE OF DOT LINE PRINTER

[75] Inventors: Masao Kunita; Toshio Kurihara, both of Tanashi, Japan

[73] Assignee: Citizen Watch Company Limited, Tokyo, Japan

[21] Appl. No.: 540,213

[22] Filed: Oct. 7, 1983

[30] Foreign Application Priority Data

Jan. 28, 1983 [JP] Japan ..... 58-011352

[51] Int. Cl.[3] ..... B41J 3/10

[52] U.S. Cl. ..... 101/93.04; 101/93.48; 400/121

[58] Field of Search ..... 400/121, 124; 101/93.04, 93.05, 93.48, 93.09

[56] References Cited

U.S. PATENT DOCUMENTS

| | | | |
|---|---|---|---|
| 3,941,051 | 3/1976 | Barrus et al. | 400/121 X |
| 4,044,668 | 8/1977 | Barrus et al. | 101/93.04 |
| 4,258,623 | 3/1981 | Barrus et al. | 101/93.48 X |
| 4,351,235 | 9/1982 | Bringhurst | 400/121 X |
| 4,357,867 | 11/1982 | Wagner et al. | 101/93.04 X |
| 4,386,563 | 6/1983 | Farb | 101/93.04 |
| 4,441,421 | 10/1984 | Khorsand | 101/93.04 |
| 4,461,207 | 7/1984 | Helinski | 101/93.48 |

*Primary Examiner*—Paul T. Sewell

*Attorney, Agent, or Firm*—Jordan and Hamburg

[57] ABSTRACT

A head for an impact type of dot line printer comprising an array of printer wires mounted on leaf springs for forming dots on a printing paper, selectively controlled for impact on the paper by signals applied to corresponding magnetic flux circuit paths comprising coils formed on coil cores and permanent magnets, and having an improved form of construction whereby each printer wire is controlled by an independent magnetic flux circuit path and with pairs of coil cores being mounted on separate magnetic flux path members. The configuration enables a high density of printer wires to be achieved, with elimination of magnetic interference between adjacent magnetic flux circuit paths leading to uniform printing density.

6 Claims, 2 Drawing Figures

HEAD FOR IMPACT TYPE OF DOT LINE PRINTER

BACKGROUND OF THE INVENTION

The present invention relates to a head for an impact type of dot line printer, to perform dot matrix printing of characters, graphics, etc.

In general, an impact type of dot line printer comprises a plurality of narrow rod-shaped members which will be referred to in the following as printer wires, for forming dots on a printing paper, arrayed in a line adjacent to a printing paper which is passed over a platen, as disclosed in a U.S. Pat. No. 3,941,051. These are controlled by electrical signals to be selectively driven into impact with the printer paper, acting through an ink ribbon, to produce a desired pattern of dots on the paper. Each of these printer wires is usually mounted on the free end of a corresponding one of an array of leaf springs, whose other end is fixedly attached to an elongated frame. A corresponding array of magnetic coils formed on coil cores are also provided, together with permanent magnets, arranged such that a magnetic flux circuit path is formed acting on each of the free ends of the leaf springs to hold that end normally in contact against the tip of a corresponding coil core by magnetic attraction, i.e. each spring is held in a state of tension. To drive a printer wire, i.e. to cause that printer wire to fly away from the corresponding coil core towards impact with the printer paper, an electrical current is passed momentarily through the corresponding coil, to thereby momentarily cancel the force of magnetic attraction.

In order to attain a high speed of printing, together with an acceptable level of pattern definition with such a printer, it is necessary to use a high density of printer wires, i.e. these must be arrayed in line as closely adjacent to one another as possible. Due to this, it is desirable to simplify the mechanical configuration of the printer head as far as possible, in order to achieve a practicable level of manufacturing cost and component assembly time. For this reason, with prior art printer heads for such dot line printers, the frame upon which the leaf springs are mounted is generally utilized as a common magnetic member for all of the magnetic flux circuit paths of the leaf springs, i.e. the frame must be formed of a magnetically permeable material, and in addition each leaf spring forms part of a magnetic flux circuit path, so that the leaf springs must also be formed of a magnetically permeable material. In the case of the frame, this has the disadvantage that it will generally be necessary to provide additional members constituting the frame (other than the main protion formed of a magnetically permeable material) having sufficient mechanical strength for the attachment of other members to the frame. Use of such a composite frame can result in bending distortion resulting from temperature increase. In the case of the leaf springs, the most suitable material from the aspects of optimum spring characteristics cannot be used to form the leaf springs. In addition, the cross-sectional area of each leaf spring must be held above a certian level, from considerations of the magnetic flux circuit path, so that the optimum shape of each leaf spring to provide optimum spring characteristics cannot be utilized. Due to these factors, maximum printing speed cannot be achieved with such a prior art head for an impact type of dot line printer.

Furthermore, since the frame of such a prior art printer head is a common to all of the magnetic flux circuit paths of the various leaf springs, magnetic coupling occurs between adjacent coils, due to magnetic flux passing through the frame. Thus, when a number of coils are driven simultaneously, magnetic interference between these can occur. Such magnetic interference can reduce the rate of rise of drive current pulses flowing in the coils, thereby hindering the movement of printer wires which are flying towards impact on the printer paper. This results in non-uniformity of printing density, and also to increased power consumption.

It has been proposed to reduce the effects of such magnetic interference by increasing the duration of pulses of drive current passed through the coils. However this will result in an increase in the coil temperature, producing an increased temperature of the printer head as a whole. This leads to restrictions on the time duration for which the printer can be continuously operated, i.e. leads to a reduced operating duty cycle.

In order to overcome these disadvantages of a prior art head for an impact type of dot line printer, the present applicant has disclosed a design for a printer head (in Japanese patent application No. 57-128761), in which each of the printer wires is controlled by a separate independent magnetic flux circuit path, with each of the coil cores being mounted on an individual magnetic flux member through which the magnetic flux circuit path of that coil core passes, rather than through the frame. In this way, interference between the magnetic flux circuit paths corresponding to the various leaf springs is eliminated, since the frame is not used as a common magnetic flux member and so can be formed of a suitable lightweight material. In addition, a stud formed of a magnetically permeable material is fixedly attached to the free end of each of the leaf springs, with the magnetic flux circuit path passing through this stud rather than through the leaf spring. In this way, the material used to form the leaf springs can be selected to provide optimum spring characteristics, with no regard for the magnetic properties of the material or the effects of cross-sectional area upon the magnetic flux circuit path.

However this method presents the following disadvantage if it is desired to provide a very high density of printer wires. Since each of the coil cores is mounted on a separate magnetic flux path member, the size of each of these magnetic flux path members must be made very small if the printer wire density is made high. As a result, these magnetic flux path members do not provide a sufficient degree of support stability for the coil cores mounted thereon. Due to this, when machining of the end faces of the coil cores is performed during manufacture (i.e. the end faces onto which the free ends of the leaf springs are to be held attracted), it is found that vibration of the coil cores is produced. This vibration causes the accuracy of this machining to be reduced, and since these end faces of the coil cores must be machined to a very high degree if accuracy in order to attain correct operation of the printer head after assembly, this is a serious disadvantage. Furthermore, with a high degree of density of the printer wires, the spacing between adjacent ones of these magnetic flux path members mounting the coil cores must be made small, and this can result in magnetic coupling between adjacent magnetic flux circuit paths, producing the type of magnetic interference described above, with the problems which arise from this.

SUMMARY OF THE INVENTION

A head for an impact type of dot line printer according to the present invention has the following essential elements. A frame formed in an elongated shape has an array of leaf springs mounted in line thereon at regular spacings, each leaf spring being fixedly attached to the frame at one end thereof by suitable attachment means and each leaf spring having a stud formed of a magnetically permeable material fixedly attached in its free end. A plurality of first yokes, each formed of a magnetically permeable material, are arrayed along the frame and fixedly attached thereto, with an air gap of fixed width being provided between adjacent ones of these first yokes. A pair of coil cores are fixedly attached to each of these first yokes, protruding outward therefrom, with a coil being formed on each of the coil cores, and with the end face of each coil core being positioned immediately behind the free end of one of the leaf springs. A plurality of magnet blocks are removably attached to first yokes, with gaps of fixed width being provided between adjacent ones of these magnet blocks, with each magnet block being positioned such as to span one of the gaps between a pair of first yokes, and each being provided with a pair of magnetic flux coupling portions at one end thereof. These magnetic flux coupling portions are positioned closely adjacent to but separated by an air gap from the ends of a corresponding pair of coil cores, these coil cores being positioned on opposite sides of an air gap of the first yokes which is spanned by the latter magnet block, i.e. the coil cores are mounted on two separate mutually adjacent first yokes. Such an arrangement ensures that the magnetic flux circuit path controlling each printer wire is substantially independent of the adjacent magnetic flux circuit paths, in spite of the fact that two coil cores are mounted on each of the first yokes, so that magnetic interference is substantially minimized when a number of coils are driven by current pulses simultaneously.

The configuration of a head for an impact type of dot line printer will be made more clear by the following description of a preferred embodiment.

DESCRIPTION OF THE PREFERRED EMBODIMENTS

Figure 1:
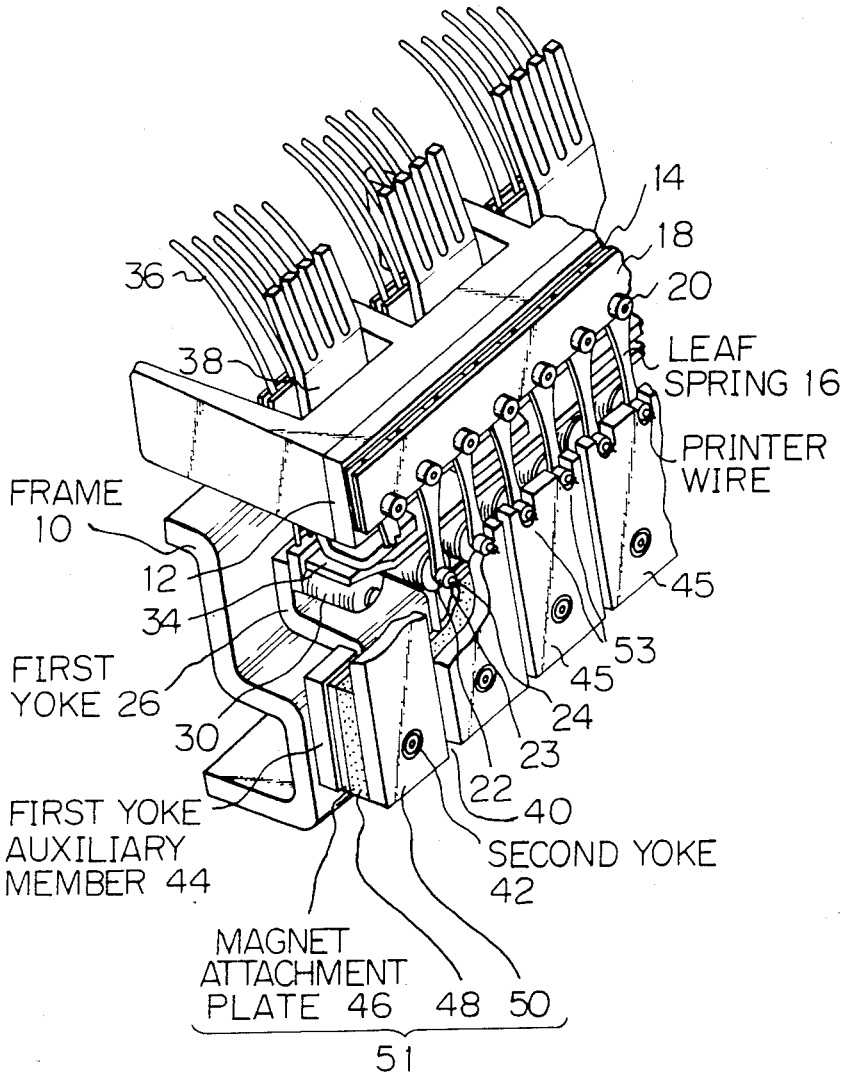
FIG. 1 is an oblique view in partial cross-section of an embodiment of a head for an impact type of dot line printer according to the present invention.
Figure 2:
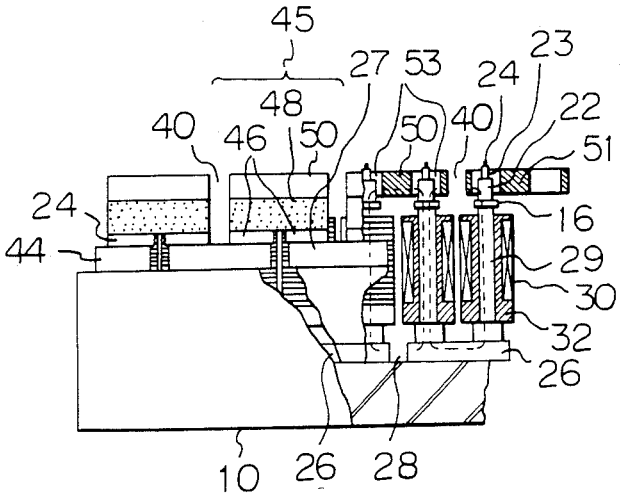
FIG. 2 is a plan view taken in partial cross-section of an end portion of the embodiment of FIG. 1, as viewed from below.

Referring to the drawings, FIGS. 1 and 2 show an embodiment of the present invention. Numeral 10 denotes a frame which is preferably formed of a lightweight, non-magnetic material, with a leaf spring supporting member 12 being fixedly attached on an upper face of frame 10. A plurality of leaf springs 16 are each fixedly attached by one end thereof to leaf spring supporting member 12 by a plurality of fixing screws 20 acting through a clamp plate 18, with a plurality of spacer members 14 being respectively positioned between adjacent ones of leaf springs 16 and between clamp plate 18 and leaf spring supporting member 12. Armatures 22, each formed in a cylindrical shape from a magnetically permeable material are respectively press-fitted into the free ends of leaf springs 16. A narrow cylindrical protruding portion 23 is formed in the upper face of each of armatures 22, with a central aperture being formed in each of these protruding portions 23, and with a printer wire 24 comprising a narrow stylus member being fixed in each of protruding portions 23, protruding outwards therefrom. Each of printer wires 24 is formed of a material having a high resistance to abrasion. A coil core 29, which in this embodiment is of cylindrical shape, is positioned opposite the rear face of the free end of each of leaf springs 16 (i.e. the end of a leaf spring in which an armature 22 is press-fitted) with a small air gap being provided between coil core 29 and said rear face in the absence of a force of magnetic attraction (described hereinafter). A pair of coil cores 29 are fixed to each of a plurality of magnetic flux path members formed of a magnetically permeable material, which will be designated as first yokes 26. First yokes 26 are fixedly attached to frame 10, with air gaps 28 of fixed width being formed between adjacent ones of first yokes 26, and with a pair of coil cores 29 being fixedly attached to each of first yokes 26 to protrude outward therefrom on the opposite side of first yoke 26 to that which abuts against frame 10. A bobbin 32 having a coil 30 formed thereon is provided on each of coil cores 29, and lead wires 36 of the coils 30 are connected to an electric circuit (not shown in the drawings) which selectively supplies pulses of drive current to coils 30. A heat conduction member 34 formed of a material having a high degree of thermal conductivity and formed in an elongated shape is fixed in close contact with the upper external surfaces of coils 30, disposed along the direction of array of coils 30. Heat radiation fins 38 are attached in close contact to heat conduction member 34, to radiate heat which is developed within coils 30 to the atmosphere.

Each of the first yokes 26 is formed with a bracket portion 27. Numeral 45 denotes a plurality of magnet blocks, arrayed in line along frame 10, and removably attached thereto. Each of magnet blocks 45 comprises a permanent magnet 48, a magnetic flux path member formed of a magnetically permeable material and designated herein as second yoke 50, with second yoke 50 being fixedly attached to one face of permanent magnet 48 which corresponds to one of the magnetic poles thereof, and a pair of magnet attachment plates 46 formed of a magnetically permeable material and fixedly attached to the opposite face of permanent magnet 48 (i.e. the face corresponding to the opposite magnetic pole) to that on which second yoke 50 is mounted.

Each of magnet blocks 45 (other than the latter two outermost ones) is positioned such as to bridge an air gap 28 between two mutually adjacent ones of bracket portions 27. Each of magnet blocks 45 is removably attached by a fixing screw 42 to frame 10.

In order to prevent a weakening of the attractive force exerted on each of the armatures 22 at the outer ends of the array of armatures 22, due to magnetic flux leakage outwards to the side of the array, each of the two magnet blocks designated as 51, which are positioned at the outer ends of the array of magnet blocks 45, is arranged to protrude beyond the outermost ones of the array of coil cores 29. These protruding portions of the outermost magnet blocks 45 accommodate the respective sides of the outermost magnet blocks and each incorporate a first yoke auxiliary member 44 which forms part of a magnetic flux path and also serves as an attachment member.

As stated above, each of the magnet blocks 45 comprises two magnet attachment plates 46, which are disposed such as to form an air gap therebetween. When the printer head is assembled, the position of each of the latter air gaps is set to correspond to one of the air gaps between two adjacent ones of bracket portions 27. Each of magnet blocks 45 is an independently removably attached unit, comprising magnet attachment plates 46, permanent magnet 48 and second yoke 50 stacked on one another, in that order, and mutually attached by means such as an adhesive agent to form a single unit. Each of second yokes 50 has two magnetic flux path coupling portions 53, each formed as a U-shaped cutout portion of the upper end of second yokes 50. Such magnetic flux path coupling portions serve to provide magnetic coupling to a corresponding pair of armatures 22, with these magnetic flux path coupling portions 53 being disposed closely adjacent to the side faces of the corresponding armatures 22, but arranged with an air gap therebetween such as not to contact armatures 22 or leaf springs 16.

Since as described above, each of magnet blocks 45 is disposed in a position such as to bridge two of bracket portions 27, the second yoke 50 corresponding to that magnet block 45 is magnetically coupled to the side faces of the two armatures which correspond to the coil cores 29 that are disposed on each side of the air gap 26 between said two of bracket portions 27.

For simplicity of description, the operation will be described for the a single one of leaf springs 16 and its corresponding printer wire 24 and magnetic flux circuit path. The magnetic flux which is produced by the magnetization force of each of permanent magnets 48 passes from second yoke 50, through the air gap of magnetic flux path coupling portion 53, through armature 22 and an adjacent part of the free end, through the air gap between the rear face of the free end of leaf spring 16 and the end face of coil core 29 into coil core 29, and hence through bracket portion 27 of first yoke 26, then through one of magnet attachment plates 46 back to permanent magnet 48. Thus, due to the magnetic flux which flows through the air gap between coil core 29 and part of the tip portion of leaf spring 16 and armature 22, a force of mutual attraction is exerted between coil core 29 and the end of leaf spring 22 having and armature mounted thereon. As a result of this attractive force, the end of leaf spring 16 is pulled into contact with coil core 29, with the latter attractive force acting in opposition to a restoring force which is exerted by leaf spring 16. Printer wire 24 is thereby held in a "waiting" condition with the corresponding leaf spring 16 in a state of tension.

If a current of suitable magnitude and direction is passed through coil 30, for a time interval of fixed duration, the attractive force exerted between coil core 29 and the end of leaf spring 16 is cancelled out, and so the end of leaf spring 16 moves rapidly towards a platen (not shown in the drawings) due to the action of the restoring force produced by leaf spring 16. Printer wire 24 thereby flies toward impact on a printer paper (not shown in the drawings) which passes over the platen, with the impact acting through an ink ribbon (not shown in the drawings). The passage of current through coil 30 is then terminated, the printer wire 24 impacts on the printer paper, and the end of leaf spring 16 is pulled back towards the end face of coil core 29, due to the rebound force which results from impact and also the attractive force exerted by the end face of coil core 29. As a result, the end portion of leaf spring 16 becomes pulled into contact against that end face of coil core 29.

Since first yoke 26 must be of sufficient size to have two of coil cores 29 fixedly attached thereto, the density of printer wires 24 can be substantially increased without the disadvantages resulting from an excessively small size of such first yokes (as described hereinabove) being encountered. That is to say, when machining of the end faces of coil cores 29 (i.e. the end faces onto which the printer wires are attracted) is performed, vibration does not occur, so that a suitable degree of machining accuracy for these end faces can be achieved. Also, mutually adjacent magnetic flux paths are each formed as a substantially closed loop, and as indicated by the broken-line portions of FIG. 2, flux linkage between mutually adjacent magnetic flux circuit paths is prevented by the interposition of either one of air gaps 28 between mutually adjacent ones of first yokes 26, or one of air gaps 40 between mutually adjacent ones of second yokes 50. Thus, magnetic interference is substantially minimized when a plurality of printer wires are driven simultaneously. As a result, a stable printing density is ensured, and in addition the power consumption is reduced since the magnetic interference is minimized and the amount of electric current flowing through each coil due to magnetic interference does not remarkably increase. As described above, the present invention discloses a configuration comprising a plurality of first yokes arranged in pairs, with an air gap provided between mutually adjacent first yokes, and with a pair of coil cores being mounted on each of the first yokes, a plurality of magnet blocks each comprising a permanent magnet and a second yoke and positioned such as to span the air gap between an adjacent pair of first yokes, each of the second yokes being magnetically coupled to side faces of two armatures each having a printer wire mounted thereon, the armatures being respectively mounted on the free ends of a plurality of leaf springs having their other ends fixedly attached to a frame.

In addition to the other advantages of a configuration for a printer head according to the present invention, the removably attached condition of the magnet blocks leads to a considerably simplification of assembly during manufacture. This is because the leaf springs can be mounted on the frame, and the positions of the printer wires adjusted to a high degree of accuracy, before the magnet blocks are attached to the printer head. Thus this adjustment work is greatly facilitated by the absence of magnetic attraction forces acting between the coil cores and the leaf springs.

It should be noted that various changes and modifications to the embodiment described above can be envisaged, which fall within the scope claimed for the present invention, as set out in the appended claims. The above specification should therefore be interpreted in a descriptive, and not in a limiting sense.

What is claimed is:

1. A head for an impact type of dot printer, comprising:

a frame formed of a non-magnetic material and having an elongated shape;

a plurality of first yokes formed of a magnetically permeable material, arrayed along the direction of elongation of said frame and fixedly attached thereto, with a gap of fixed width being provided between mutually adjacent ones of said first yokes;

a plurality of coil cores arrayed at regular intervals along the direction of elongation of said frame, with a pair of said coil cores being fixedly attached to each of said first yokes and disposed to protrude outward therefrom;

a plurality of coils, each formed on a corresponding one of said coil cores;

a plurality of magnet blocks arrayed along the direction of elongation of said frame, each provided with attachment means, with a gap of fixed width being provided between mutually adjacent ones of said magnet blocks, each of said magnet blocks being positioned such as to span a gap between a pair of mutually adjacent ones of said first yokes, and each comprising a permanent magnet and a second yoke mutually fixedly attached to form an integral unit, each of said second yokes being formed of a magnetically permeable material and having a pair of magnetic coupling portions formed at one end thereof, said magnetic coupling portions being disposed respectively closely adjacent to and separated by an air gap of fixed width from the end portions of a corresponding pair of said coil cores which are disposed on opposite sides of a gap formed between a corresponding pair of said first yokes to which said pair of coil cores are respectively fixedly attached, whereby said permanent magnet has one magnetic pole thereof coupled to a corresponding one of said second yokes and the opposite magnetic pole thereof coupled through said pair of coil cores to said first yokes on which said coil cores are attached;

a plurality of leaf springs arrayed along the direction of elongation of said frame, each of said leaf springs having one end thereof fixedly attached to said frame and having the free end thereof disposed adjacent to the outer end of a corresponding one of said coil cores;

a plurality of armatures, each formed of a magnetically permeable material and fixedly attached at the free end of a corresponding one of said leaf springs, and;

a plurality of printer rods arrayed along the direction of elongation of said frame, each of said printer rods being fixedly attached to a corresponding one of said armatures and protruding outward therefrom;

each of said magnet blocks acting in conjunction with said corresponding pair of first yokes and a corresponding pair of said armatures to form a corresponding pair of magnetic flux circuits for the magnetic flux of said permanent magnet, said magnetic flux circuits acting to normally retain the free ends of corresponding ones of said leaf springs in contact with the ends of said corresponding pair of coil cores by magnetic attraction acting upon said corresponding pair of armatures in opposition to the forces of said leaf springs, each of said coils being responsive to apulse of drive current passed therethrough for momentarily producing a magnetic flux which acts in opposition to the magnetic flux of the corresponding permanent magnet to thereby momentarily release the corresponding leaf spring from the magnetically attracted condition thereof.

2. A head for an impact type of dot printer according to claim 1, in which the two outermost ones of said plurality of magnet blocks each further comprises a first yoke attachment member formed of a magnetically permeable material and fixedly attached to one of said magnet attachment plates thereof, with the portion of each of said outermost magnet blocks having a first yoke attachment member attached thereto being disposed extending along the direction of elongation of said frame beyond an outermost one of said array of coil cores, and with each of said first yoke attachment members being disposed closely adjacent to an outermost one of said first yokes, with an air gap of fixed width provided therebetween.

3. A head for an impact type of dot printer according to claim 1, in which said attachment means of said magnet blocks comprise a plurality of pairs of magnet attachment plates formed of a permeable material, each of said pairs of magnet attachment plates being disposed with a gap of fixed width therebetween and fixedly attached to a permanent magnet of a corresponding one of said magnet blocks on the opposite pole of said permanent magnet to that of the corresponding one of said second yokes, said gap between said pair of magnet attachment plates being aligned such as to substantially overlap a gap between a corresponding pair of said first yokes.

4. A head for an impact type of dot printer according to claim 3, in which said attachment means further comprise a plurality of fixing screws engaging with said frame, each of said fixing screws bearing against one of said pairs of magnet attachment plates of a magnet block.

5. A head for an impact type of dot printer according to claim 1, in which said attachment means further comprise a first yoke auxiliary member which forms part of a magnetic flux path.

6. A head for an impact type of dot printer according to claim 1, in which each of said magnetic coupling portions of said second yokes is in the form of a U-shaped cut-out portion thereof, and in which each of said armatures is of cylindrical shape, each of said magnetic coupling portions being disposed adjacent to and partially surrounding the periphery of a corresponding one of said armatures with an air gap of fixed width provided therebetween.

* * * * *